United States Patent [19]

Barker

[11] 3,999,795

[45] Dec. 28, 1976

[54] VACUUM PAD SYSTEM

[75] Inventor: Loren B. Barker, Salem, Ill.

[73] Assignee: American Chain & Cable Company, Inc., Bridgeport, Conn.

[22] Filed: Dec. 17, 1975

[21] Appl. No.: 641,497

[52] U.S. Cl. ..... 294/64 R; 214/1 BS; 271/90; 271/108

[51] Int. Cl.[2] ..... B66C 1/02

[58] Field of Search ..... 294/1 R, 64 R, 65, 86 R; 62/195, 303; 214/1 BS, 650 SG; 269/21; 271/90, 105, 108

[56] References Cited

UNITED STATES PATENTS

| | | | |
|---|---|---|---|
| 2,887,849 | 5/1959 | Lytle | 294/64 R |
| 2,999,715 | 9/1961 | Firestone | 294/64 R |
| 3,219,380 | 11/1965 | Carliss | 294/64 R |
| 3,220,723 | 11/1965 | Rabinow | 294/64 R X |

*Primary Examiner*—Johnny D. Cherry
*Attorney, Agent, or Firm*—Barnes, Kisselle, Raisch & Choate

[57] ABSTRACT

A vacuum pad system comprising a plurality of vacuum pads to which vacuum is selectively supplied and a de-icer supply mechanism selectively connected to the vacuum pads to supply de-icer to the pads and thereby to purge the pads.

5 Claims, 2 Drawing Figures

VACUUM PAD SYSTEM

This invention relates to vacuum pad systems.

BACKGROUND OF THE INVENTION

In handling of articles, it is common to provide a vacuum pad system comprising a plurality of vacuum pads which engage the article and lift it for transportation or manipulation. Where the system is utilized in a cold and moist environment, it is possible that moisture will enter the pads and the lines leading to the source of vacuum and thereby adversely affect the system.

Accordingly, among the objects of the invention are to provide a method and apparatus for preventing adverse damage to the system by moisture; which method and apparatus can be readily adapted to present vacuum systems.

SUMMARY

In accordance with the invention, a method and apparatus is provided for selectively supplying vacuum or de-icer to the vacuum pads so that the pads are periodically purged of moisture.

DESCRIPTION

Figure 1:
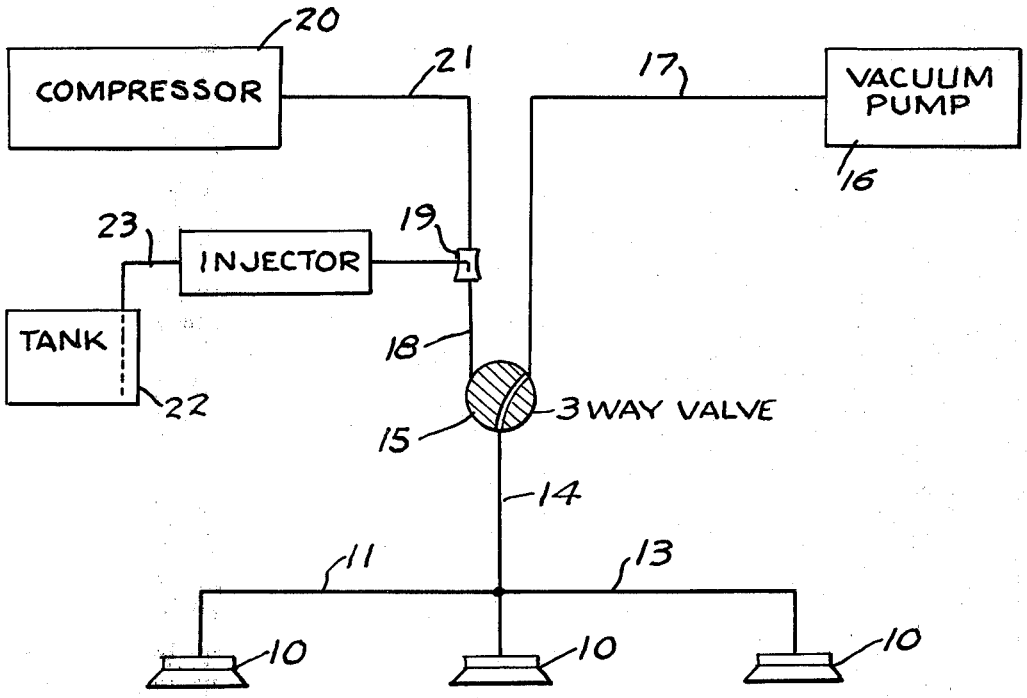
FIG. 1 is a diagrammatic view of an apparatus embodying the invention.

Referring to FIG. 1, the invention relates to a vacuum pad system comprising a plurality of vacuum pads 10 that are connected by lines 11, 12 and 13 to a line 14 which in turn extends to a three-way valve 15. The valve 15 is connected in turn to a source of vacuum such as a vacuum pump 16 through a line 17 as well as to a source of de-icer fluid by a line 18 that extends to an injector 19 that has air under pressure supplied thereto by a compressor 20 through a line 21. The injector is in turn connected to a source of de-icer fluid 22 by a line 23.

In accordance with the invention, vacuum is selectively applied to the pads 10 to lift and transport and manipulate articles. Periodically the three-way valve 15 is shifted so that the vacuum is cut off and air under pressure is supplied by the compressor carrying with it de-icer fluid from the injector through the lines 11–14 thereby purging the lines of moisture. In a very cold and damp environment, the purging is preferably done upon each manipulation, that is, each time an article is handled and the vacuum is cut off.

Figure 2:
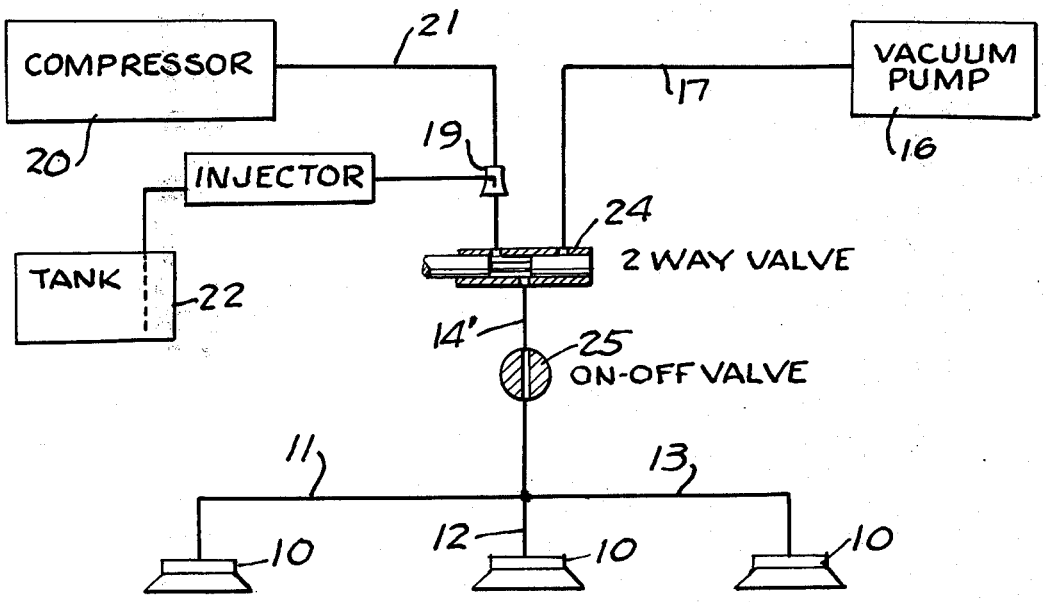
FIG. 2 is a diagrammatic view of a modified form of apparatus.

In the form of the invention shown in FIG. 2, the three-way valve 15 is replaced by a two-way valve 24 and an on-off valve 25 in series with the two-way valve so that the two-way valve connects either the vacuum pump or compressor to the line 14' and one or the other or neither vacuum or air are supplied depending upon the position of the on-off valve 25.

The de-icer fluid utilized in the invention can be any of the well known liquid de-icer fluids such as alcohol-anti-freeze or preferably the de-icer as sold under the trademark TANNER GAS or FROSTO and manufactured by the Tanner Systems, Inc.

The TANNER GAS readily atomizes into the air stream, and yet, has a greater affinity for water. Thus the air stream acts as a means to convey the gas to areas where water exists and then the gas readily mixes with the water in sufficient quantity to reduce the freezing point of the solution to minus 70° F.

Not only does the compressed air act as a means of conveying the gas, but it also removes excess moisture by jetting through the air lines and related components.

Using the surge tank principle insures that all lines and components in the system receive sufficient treatment to prevent freezing.

I claim:

1. In a vacuum pad system, the combination comprising at least one vacuum pad, means for supplying vacuum to said pad, means for supplying a de-icer fluid to said pad, and means for selectively connecting said vacuum supplying means and said de-icer fluid supplying means to said pad.

2. The combination set forth in claim 1 wherein said means for supplying de-icer fluid to said pad comprises a compressor which has an output for passing air to said pad, an injector in series with said compressor output such that when said compressor output is connected to said pad, said injector will inject de-icer fluid into said air passing to said pad.

3. The combination set forth in claim 1 wherein said means for selectively connecting said vacuum supplying means and said de-icer fluid supplying means to said pad comprises a three-way valve.

4. The combination set forth in claim 1 wherein said means for selectively connecting said vacuum supplying means and said de-icer fluid supplying means to said pad comprises a two-way valve to which said vacuum supplying means and said de-icer fluid supplying means are connected and an on-off valve interposed between said pad and said two-way valve.

5. The method of operating a vacuum pad system which comprises periodically interrupting the application of vacuum to the vacuum pads and directing de-icer fluid under pressure through said vacuum pads.

* * * * *